US010094144B2

(12) United States Patent
Adelman et al.

(10) Patent No.: US 10,094,144 B2
(45) Date of Patent: Oct. 9, 2018

(54) SYSTEMS AND METHODS FOR A KEY COVER WITH AN INTEGRATED LABEL

(71) Applicant: Nite Ize, Inc., Boulder, CO (US)

(72) Inventors: Gregory M. Adelman, Boulder, CO (US); Peter Trench, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 15/598,899

(22) Filed: May 18, 2017

(65) Prior Publication Data

US 2017/0335601 A1 Nov. 23, 2017

Related U.S. Application Data

(60) Provisional application No. 62/338,247, filed on May 18, 2016.

(51) Int. Cl.

| | |
|---|---|
| ***E05B 19/04*** | (2006.01) |
| ***E05B 19/24*** | (2006.01) |
| ***G09F 3/04*** | (2006.01) |
| *E05B 19/00* | (2006.01) |
| *B21D 53/42* | (2006.01) |
| *B21D 53/38* | (2006.01) |

(52) U.S. Cl.

CPC ..... *E05B 19/24* (2013.01); *G09F 3/04* (2013.01); *B21D 53/38* (2013.01); *B21D 53/42* (2013.01); *E05B 19/00* (2013.01); *E05B 19/0088* (2013.01)

(58) Field of Classification Search

CPC ..... E05B 19/24; E05B 19/00; E05B 19/0088; E05B 19/0082; E05B 19/04; G09F 3/04; B21D 53/38; B21D 53/42; Y10T 70/7876

USPC ..... 70/395, 408, 456 R, 456 B, 457–460; 24/3.6; 206/38.1, 37.1–37.8; 40/330, 40/634

See application file for complete search history.

(56) References Cited

U.S. PATENT DOCUMENTS 2,109,268 A * 2/1938 I'Anson ..... G09F 3/12 40/330
2,130,469 A * 9/1938 Nasser ..... A45C 11/323 206/37.1
2,432,498 A * 12/1947 Bloomfield ..... E05B 19/24 116/205
3,225,478 A * 12/1965 Rohmer ..... E05B 19/24 40/330
3,313,137 A * 4/1967 Maier ..... A45C 11/328 362/116
3,729,965 A * 5/1973 Gartner ..... E05B 19/04 70/395
4,349,975 A * 9/1982 Chubb ..... E05B 19/24 40/330

(Continued)

OTHER PUBLICATIONS

International Search Report and Written Opinion dated Aug. 4, 2017 issued in related PCT App. No. PCT/US2017/033313 (11 pages).

*Primary Examiner* — Lloyd A Gall
(74) *Attorney, Agent, or Firm* — Haynes and Boone, LLP; Robert P. Ziemian

(57) ABSTRACT

A key cover includes a body, the body including an aperture, the aperture shaped for receiving a key. The key cover further includes a flap, the flap interconnected with the body, the flap shaped such that the flap is foldable to an interior area of the body, the interior area is larger than the aperture, and the aperture leads to the interior area.

12 Claims, 2 Drawing Sheets

(56) References Cited

U.S. PATENT DOCUMENTS

| | | | | | |
|---|---|---|---|---|---|
| 4,403,487 | A * | 9/1983 | Marty | E05B 19/24 | 283/74 |
| 4,417,410 | A * | 11/1983 | Freedom | G09F 3/04 | 40/330 |
| 4,796,750 | A | 1/1989 | Inghram | | |
| 5,038,590 | A * | 8/1991 | Sawyer | E05B 19/04 | 70/408 |
| 5,083,662 | A | 1/1992 | Bishop et al. | | |
| 5,113,602 | A | 5/1992 | Levine et al. | | |
| 5,181,605 | A * | 1/1993 | Bishop | E05B 19/24 | 206/37.1 |
| 5,291,768 | A * | 3/1994 | Rieffel | A44B 15/00 | 40/634 |
| 6,089,060 | A * | 7/2000 | Steeley | E05B 19/00 | 40/323 |
| 6,928,845 | B2 * | 8/2005 | Howard | E05B 19/24 | 70/395 |
| 6,951,122 | B1 * | 10/2005 | Jheng | E05B 19/04 | 40/330 |
| 7,360,383 | B1 * | 4/2008 | Chang | E05B 19/04 | 40/330 |
| 2008/0142129 | A1 | 6/2008 | Reasner et al. | | |

* cited by examiner

SYSTEMS AND METHODS FOR A KEY COVER WITH AN INTEGRATED LABEL

CROSS-REFERENCE TO RELATED APPLICATION

This application claims the benefit of U.S. Provisional Application No. 62/338,247 filed on May 18, 2016 which is incorporated herein by reference in its entirety.

BACKGROUND

In many scenarios, individuals may acquire and find usage for a large number of keys. Additionally, keys may look substantially similar and have substantially similar usages. It may be difficult to identify what keys are associated with what lock for a user. Many key labeling systems exist; however, it is thought that these systems each have their own disadvantages. Disadvantages include the requirement of multiple pieces to mark a key, the requirement that standard descriptors be used, or the likelihood that an indicator will be worn off. Additionally, fabrication for key markers may be difficult.

BRIEF SUMMARY

In one embodiment, a key cover includes a body, the body including an aperture, the aperture shaped for receiving a key. The key cover further includes a flap, the flap interconnected with the body, the flap shaped such that the flap is foldable to an interior area of the body, the interior area larger than the aperture, the aperture leading to the interior area. Alternatively, the interior area of the body includes a receiver for receiving the flap, the receiver approximately sized to receive the flap. In one alternative, the key cover is made of a translucent material. In another alternative, the flap is markable with a writing implement. Optionally, the aperture is smaller than a head of a standard key that the aperture is designed to receive, and the key cover and aperture stretch to receive the standard key. Alternatively, the flap folds along a joint toward the interior area. Optionally, the key cover is a singular piece of extruded material. In one configuration, the body includes an aperture for receiving a key ring. In another configuration, the outer surface of the body is textured. In another embodiment, the flap folds along a joint toward the interior area through the aperture. Optionally, the interior area of the body includes a receiver for receiving the flap, the receiver approximately sized to receive the flap and the receiver is located directly adjacent to the aperture.

In one embodiment, a cover for a head of a key includes a body having a cavity, an outer surface of the cavity, and an interior surface of the cavity. The cover further includes a tab, connected to the body via a joint, the tab oriented to fold about the joint, an aperture leading to the cavity, the tab foldable through an aperture of the body such that the tab rests proximate to the interior surface. Optionally, the interior surface includes a recess for receiving the tab, the recess approximately the size of the tab. Alternatively, the body is made of a translucent material. In one alternative, the body is made of a transparent material. In another alternative, the tab is markable with a writing instrument. Optionally, the tab and body are a singular piece of extruded material. Alternatively, the aperture of the body is narrower than a width of a standard key. In one configuration, the cavity is similar in size to the standard key. In another configuration, the body is made of a stretchable material.

In one embodiment, a method of identifying a key includes providing a key cover including a body having a cavity, an outer surface of the cavity, and an interior surface of the cavity; and a tab, connected to the body via a joint, the tab oriented to fold about the joint, an aperture leading to the cavity, the tab foldable through an aperture of the body such that the tab rests proximate to the interior surface. The method further includes marking the tab with a writing instrument. The method further includes folding the tab such that it rests proximate to the interior surface of the cavity; and inserting a head of the key into the cavity. Alternatively, the folding is accomplished by setting the tab in front of the aperture and pushing the tab with the key and wherein the inserting includes stretching the aperture over the head of the key.

DETAILED DESCRIPTION

Figure 1:
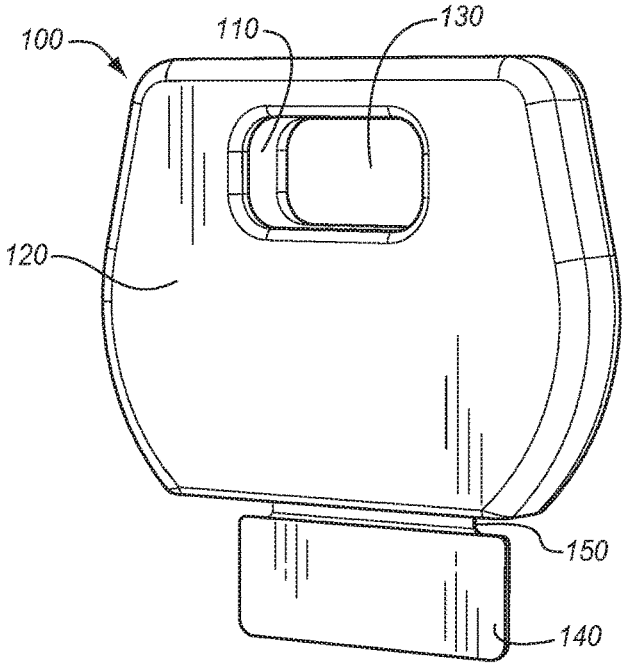
FIG. 1 show a front perspective view of one embodiment of a key cover.

Certain terminology is used herein for convenience only and is not to be taken as a limitation on the embodiments of the systems and methods for a key cover with an integrated label. In the drawings, the same reference numbers are employed for designating the same elements throughout the several figures.

Figure 2:
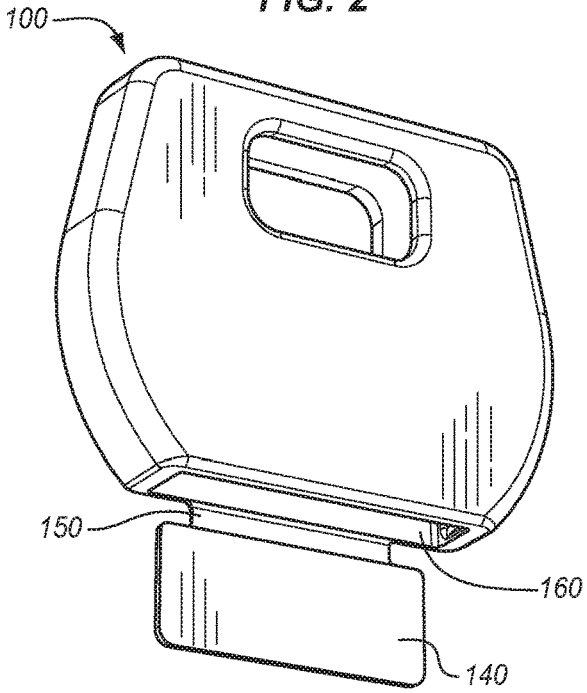
FIG. 2 shows a rear perspective view of the key cover of FIG. 1.

FIG. 1 show a front perspective view of one embodiment of a key cover 100. Key cover 100 includes an inner area 110 and an outer surface 120, the inner area shaped to receive a standard key. The outer surface 120 may be textured to increase the ease of handling and preventing slippage of the user's hand. The shown key cover 100 is purely exemplary, and various shapes will be apparent to those of ordinary skill in the art corresponding to the various shapes of typical keys. Key cover 100 typically includes an aperture 130 for receiving a key ring or other holder. Placing a key ring through aperture 130 also assist in securing the cover 100. Key cover 100 also includes a flap 140 connected via a joint 150. In many embodiments, the joint may be a thinned piece of material. In many embodiments, the joint may not be affirmatively defined and is merely the point at which the flap naturally folds. The natural fold point is typically where the flap attaches to the remaining portion of the body. As shown in FIG. 2, the bottom of key cover 100 includes an aperture 160 for receiving a key. Additionally, flap 140 may fold into aperture 160 along joint 150. Flap 140 may be advanced into aperture 160 by the key that is intended to be held in key cover 100.

Prior to the insertion of flap 140 into aperture 160, the user may write on the surface of flap 140. Additionally, the user may insert a printed label or affix a sticker to the surface. Then, when flap 140 is folded, the user may see flap 140 through the body of key cover 100. Typically, key cover 100 is made of a transparent or translucent flexible (or stretchy) material that may be seen through and may stretch or flex to surround and be placed around a key. Key cover 100 may be made of silicon, TPE (thermoplastic elastomer), or like materials.

Figure 3:
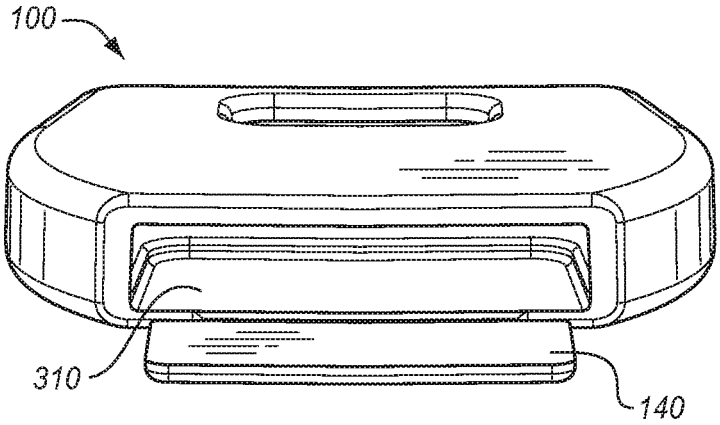
FIG. 3 shows a bottom view of the key cover of FIG. 1.

Additionally, as is visible in FIG. 3, key cover 100 includes a receiver 310 for receiving flap 140. Typically, receiver 310 is a depression in the inside cover of key cover

100. Receiver 310 may be shaped to receive flap 140. In many configurations, the thickness of key cover 100 is simply reduced in the area of receiver 310. Alternatively, the key cover 100 is shaped, such that the key cover 100 protrudes slightly where receiver 310 is located, such that the receiver may receive the flap 140. In some embodiments there is no receiver. In some configurations, flap 140 may be omitted and the key cover may merely include receiver 310. The user may turn the key cover 100 inside-out and the receiver may be written in, or a tag or label may be affixed into receiver 310. Additionally, the receiver 310 may be described as an area that is shaped to receive the flap 140, such that when the flap 140 is in receiver 310, the inner portion of the key cover 100 is approximately flat.

Generally, in usage, key cover 100 includes an aperture for receiving a key. The aperture is designed to be smaller than the width of the head it is designed to receive. In this way, the aperture will stretch or flex. In general, the flap need only be folded such that it blocks the aperture; the insertion of the key will generally push the flap or tab into place. The placement and folding of the tab provides for a single piece item in which the writing or other marks on the tab are unlikely to be worn off, since the writing is folded in internally and, therefore, protected by the key cover. The key cover 100 may be formed according to a variety of different methods including molding and extrusion, etc. In many embodiments, the key cover 100 is a single piece of material.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A key cover, comprising:

a body, the body including an aperture, the aperture shaped for receiving a key; and a flap, the flap interconnected with the body, the flap shaped such that the flap is foldable to an interior area of the body, the interior area larger than the aperture, the aperture leading to the interior area, wherein the interior area of the body includes a receiver for receiving the flap, the receiver approximately sized to receive the flap, and the receiver is a recess in an interior surface of the body.

2. The key cover of claim 1, wherein the aperture is smaller than a head of a standard key that the aperture is designed to receive, and the key cover and aperture flex to receive the standard key.

3. The key cover of claim 2, wherein the flap folds along a joint toward the interior area.

4. The key cover of claim 3, wherein the key cover is a singular piece of material.

5. The key cover of claim 4, wherein the body includes an aperture for receiving a key ring.

6. The key cover of claim 1, wherein the flap folds along a joint toward the interior area through the aperture.

7. The key cover of claim 6, wherein the receiver is located directly adjacent to the aperture.

8. A cover for a head of a key, the cover comprising:

a body having a cavity, an outer surface of the cavity, and an interior surface of the cavity;

a tab, connected to the body via a joint, the tab oriented to fold about the joint; and an aperture leading to the cavity, the tab foldable through the aperture of the body such that the tab rests proximate to the interior surface, wherein the interior surface include a recess for receiving the tab, the recess approximately the size of the tab.

9. The cover of claim 8, wherein the tab and body are a singular piece of material.

10. The cover of claim 8, wherein the cavity is similar in size to a standard key.

11. The cover of claim 10, wherein the body is made of a stretchable material.

12. A method of identifying a key, the method comprising:

providing a key cover including a body having a cavity, an outer surface of the cavity, and an interior surface of the cavity; and a tab, connected to the body via a joint, the tab oriented to fold about the joint, an aperture leading to the cavity, the tab foldable through the aperture of the body such that tab rests proximate to the interior surface;

marking the tab with a writing instrument;

folding the tab such that it rests proximate to the interior surface of the cavity; and inserting the head of the key into the cavity; wherein the folding is accomplished by setting the tab in front of the aperture and pushing the tab with the key, and wherein the inserting includes stretching the aperture over the head of the key.

* * * * *